US009746231B2

(12) United States Patent
Moon et al.

(10) Patent No.: US 9,746,231 B2
(45) Date of Patent: Aug. 29, 2017

(54) INDOOR UNIT OF CEILING TYPE AIR-CONDITIONER

(71) Applicant: SAMSUNG ELECTRONICS CO., LTD., Suwon-si, Gyeonggi-do (KR)

(72) Inventors: Hong Yeol Moon, Suwon-si (KR); Yeon Su Kim, Seongnam-si (KR); Hyun Ho Kim, Suwon-si (KR); Jin Hyung Nam, Suwon-si (KR); Jae Sung Yoo, Yongin-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 320 days.

(21) Appl. No.: 14/539,523

(22) Filed: Nov. 12, 2014

(65) Prior Publication Data

US 2015/0129179 A1 May 14, 2015

(30) Foreign Application Priority Data

Nov. 12, 2013 (KR) ..... 10-2013-0137053

(51) Int. Cl.
*F28D 1/06* (2006.01)
*F25D 17/06* (2006.01)
(Continued)

(52) U.S. Cl.
CPC ..... *F25D 17/06* (2013.01); *F24F 1/0007* (2013.01); *F24F 13/20* (2013.01); *F24F 2001/0037* (2013.01)

(58) Field of Classification Search
CPC ..... B29L 2031/18; F25D 17/06; F25D 23/00; B29K 2995/002; B29K 2995/0026;
(Continued)

(56) References Cited

U.S. PATENT DOCUMENTS 5,943,873 A * 8/1999 Chung ..... F24F 1/027 62/262
6,196,018 B1 * 3/2001 Mori ..... F24F 1/0007 454/313
(Continued)

FOREIGN PATENT DOCUMENTS

EP 1 471 310 10/2004
EP 2 299 193 3/2011
(Continued)

OTHER PUBLICATIONS

International Search Report dated Feb. 17, 2015 from International Patent Application No. PCT/KR2014/010816, 3 pages.
(Continued)

*Primary Examiner* — Justin Jonaitis
(74) *Attorney, Agent, or Firm* — Staas & Halsey LLP

(57) ABSTRACT

An indoor unit of a ceiling type air-conditioner includes a main body having an inlet port and an outlet port provided at a lower portion thereof, a heat exchanger having a tube through which a refrigerant flows, a blowing fan which forcibly causes air to flow, and a control box comprising a case which is fixed to the main body and a cover which is rotatably coupled to the case so as to open and close the case and to which a printed circuit board having electronic components mounted thereon is fixed.

29 Claims, 8 Drawing Sheets

(51) Int. Cl.
*F24F 13/20* (2006.01)
*F24F 1/00* (2011.01)

(58) Field of Classification Search
CPC .. F24F 1/0007; F24F 13/20; F24F 2001/0037; F24F 13/082; B29C 45/162; B29C 2045/1687
USPC ..... 165/72; 361/697, 696, 695, 694, 691, 361/690; 454/136, 139, 158, 329, 248, 454/292, 349, 354
See application file for complete search history.

(56) References Cited

U.S. PATENT DOCUMENTS

2007/0066215 A1* 3/2007 Song ..... B01D 46/0004 454/329
2008/0148749 A1* 6/2008 Ishida ..... F24F 11/001 62/157
2009/0025413 A1* 1/2009 Koga ..... F24F 1/00 62/259.1
2011/0048050 A1* 3/2011 Motek ..... F24F 1/0007 62/263
2015/0009626 A1* 1/2015 Lan ..... H05K 7/20163 361/696

FOREIGN PATENT DOCUMENTS

| | | |
|---|---|---|
| GB | 2 155 616 | 9/1985 |
| JP | 8-200730 | 8/1996 |
| KR | 1999-0018157 | 6/1999 |
| KR | 2001-0065325 | 7/2001 |
| KR | 2003-0055725 | 7/2003 |
| KR | 10-2009-0078477 | 7/2009 |
| WO | 2013/129527 | 9/2013 |

OTHER PUBLICATIONS

Australian Office Action dated Nov. 3, 2016 from Australian Patent Application No. 2014349358, 3 pages.
Australian Office Action dated Mar. 21, 2017 from Australian Patent Application No. 2014349358, 3 pages.
Extended European Search Report dated Jun. 12, 2017 from European Patent Application No. 14862664.1, 7 pages.

* cited by examiner

INDOOR UNIT OF CEILING TYPE AIR-CONDITIONER

CROSS-REFERENCE TO RELATED APPLICATIONS

This application claims the benefit of Korean Patent Application No. 10-2013-0137053, filed on Nov. 12, 2013 in the Korean Intellectual Property Office, the disclosure of which is incorporated herein by reference.

BACKGROUND

1. Field

Embodiments disclosed herein relate to an indoor unit of a ceiling type air-conditioner, and more particularly, to a control box which controls an operation of the ceiling type air-conditioner.

2. Description of the Related Art

In general, an air-conditioner refers to an appliance (e.g., a home or residential appliance or commercial appliance) which keeps indoor air at a pleasant temperature using a cooling cycle of a refrigerant, and may include an indoor unit which has a heat exchanger, a blowing fan and so on, and is disposed in a room, and an outdoor unit which has a heat exchanger, a blowing fan, a compressor, a condenser and so on, and is disposed outside of the room, and a refrigerant pipe which connects the indoor unit and the outdoor unit and through which the refrigerant circulates.

According to an installation place of the indoor unit, an air-conditioner may be classified, for example, as a stand type air-conditioner in which the indoor unit is installed on a floor, a wall mounted type air-conditioner in which the indoor unit is installed on a wall, or a ceiling type air-conditioner in which the indoor unit is installed on a ceiling. In the ceiling type air conditioner, the indoor unit may be buried in or suspended from the ceiling.

When the indoor unit of the ceiling type air-conditioner is installed at the ceiling, an inlet port which sucks indoor air and an outlet port through which air heat-exchanged through the heat exchanger is discharged into the room, are provided at a lower portion of a main body of the indoor unit. The indoor unit of the ceiling type air-conditioner may be classified, for example, as a one-way type having one outlet port or a four-way type having four outlet ports with a quadrangular shape, according to the number of outlet ports.

A printed circuit board on which various electronic components for controlling an operation of the indoor unit of the ceiling type air-conditioner are mounted, may be received (provided or disposed) in a control box and installed in the main body. Generally, the control box may include a box-shaped case of which a bottom surface is opened, and a cover which is removably coupled to the case so as to open and close the opened bottom surface of the case. The printed circuit board may be horizontally fixed into the case so that a surface thereof on which the electronic components are mounted is directed downward.

Therefore, when it is necessary to access (e.g., to maintain, repair, or replace) the electronic components in the control box, the cover is first separated from the case, and then maintenance thereof is performed. After the maintenance thereof is completed, the cover is coupled to the case again. However, since the indoor unit is installed at the ceiling, it is difficult to perform these processes.

Further, the control box of the indoor unit of the one-way ceiling type air conditioner is generally installed at an inner side of a side wall of the main body adjacent to the inlet port.

At this time, the printed circuit board is horizontally arranged so that the mounted electronic components are directed downward, and thus the control box is installed so that a transversal width thereof is greater than a longitudinal width thereof when seen in an axial direction of the blowing fan.

As described above, since the transversal width of the control box is greater than the longitudinal width thereof, the control box may block the inlet port and cause problems with air flow. Further, in the specification in which the inlet port itself is narrow, it may be difficult to apply the control box of such a structure.

SUMMARY

Therefore, it is an aspect of the disclosure to provide an indoor unit of a ceiling type air-conditioner, which has a control box in which a cover and a case are easily coupled and separated, and thus it is easy to connect a wire and to easily perform maintenance or otherwise access the interior of the control box.

Also, it is another aspect of the disclosure to provide an indoor unit of a ceiling type air-conditioner, which has a control box capable of minimizing problems with air flow of an inlet port and also being applicable to a narrow inlet port.

Additional aspects of the disclosure will be set forth in part in the description which follows and, in part, will be apparent from the description, or may be learned by practice of the disclosure.

In accordance with an aspect of the disclosure, an indoor unit of a ceiling type air-conditioner may include a main body having an inlet port and an outlet port provided at a lower portion thereof, a heat exchanger having a tube through which a refrigerant flows, a blowing fan which forcibly causes air to flow, and a control box including a case which is fixed to the main body and a cover which is rotatably coupled to the case so as to open and close the case and to which a printed circuit board having electronic components mounted thereon is fixed.

A rotational shaft of the cover may be in parallel with a rotational shaft of the blowing fan and located at an upper portion of the control box.

The cover may be opened while being rotated upward, and closed while being rotated downward.

The printed circuit board may be located to be vertical when the cover is closed.

The printed circuit board may be located so that a surface thereof on which the electronic components are mounted is directed downward when the cover is opened.

A maximum rotational angle of the cover may be in a range of about 70° to about 90°.

A transversal width of the control box may be smaller than a longitudinal width thereof when seen in an axial direction of a rotational axis of a rotational shaft of the cover.

The control box may be installed at an inner side of a side wall of the main body adjacent to the inlet port.

The indoor unit of the ceiling type air-conditioner may further include a guide rib which is provided adjacent to the heat exchanger and guides indoor air sucked through the inlet port to the heat exchanger.

The control box may be installed between the guide rib and the side wall of the main body.

The guide rib may interfere with the cover, and thus the maximum rotational angle may be limited.

The case may include a fixed coupling part which guides rotation of the cover.

The fixed coupling part may have a ring shape or a partly cut-away ring shape.

The cover may include a rotational coupling part which is rotatably coupled to the fixed coupling part.

The rotational coupling part may have a ring shape or a partly cut-away ring shape.

Each of the fixed coupling part and the rotational coupling part may have a wiring groove through which a wire connected to the printed circuit board passes.

A position of the wiring groove may not be changed even when the cover is rotated.

The fixed coupling part and the rotational coupling part may have stopper protrusions which are mated with each other so as to fix the cover when the cover is opened.

The cover and the case may be coupled with each other by a fastening member, (e.g., a screw) so that the cover is fixed when the cover is closed.

The case may be formed by coupling a case body formed of a metallic material and a guide member which has the fixed coupling part and is formed by injection-molding a resin material.

The cover may be formed by coupling an external cover formed of a metallic material and an internal cover which has the rotational coupling part, has the printed circuit board fixed thereto, and is formed by injection-molding a resin material.

In accordance with an aspect of the disclosure, an indoor unit of a ceiling type air-conditioner may include a main body having an inlet port and an outlet port provided at a lower portion thereof, a heat exchanger having a tube through which a refrigerant flows, a blowing fan which forcibly causes air to flow, a guide rib which is provided adjacent to the heat exchanger and guides indoor air sucked through the inlet port to the heat exchanger, and a control box. The control box may include a case which is fixed to a side wall of the main body and a cover which is coupled to the case so as to be rotatable around a horizontal rotational axis and thus opens and closes the case, wherein the control box may be installed between the side wall of the main body and the guide rib, such that a transversal width thereof is smaller than a longitudinal width thereof when seen in an axial direction of the horizontal rotational axis.

In accordance with an aspect of the disclosure, an indoor unit of a ceiling type air-conditioner may include a main body having an inlet port and an outlet port provided at a lower portion thereof, a heat exchanger having a tube through which a refrigerant flows, a blowing fan which forcibly causes air to flow, and a control box including a case which is fixed to the main body and has a fixed coupling part, and a cover which has a rotational coupling part rotatably coupled to the fixed coupling part and is rotatable around a horizontal rotational axis, wherein each of the fixed coupling part and the rotational coupling part has a wiring groove through which a wire passes.

In accordance with an aspect of the disclosure, a ceiling type air-conditioner may include an outdoor unit and an indoor unit, where the indoor unit may include a main body having an inlet port and an outlet port provided at a lower portion thereof, and a control box which includes a case fixed to the main body, a cover which is rotatable to access an inside of the control box, and a printed circuit board disposed inside the control box.

When the cover is in a closed position, the printed circuit board may be arranged vertically to be parallel to a side wall of the main body such that electronic components mounted on the printed circuit board are directed in a substantially perpendicular direction to the side wall. When the cover is rotated to an open position, the printed circuit board may move together with a rotation of the cover, such that the electronic components mounted on the printed circuit board may be directed to face toward the lower portion of the main body.

A width of the control box corresponding to a first direction which is parallel to a horizontal ground plane may be less than a length of the control box in a second direction which is perpendicular to the horizontal ground plane and parallel to the side wall.

The control box may include an internal member which is coupled to the cover on one side, and is coupled to the printed circuit board and the case on the other side, and the internal member may include a first coupling part which is coupled together with a second coupling part disposed at the case such that the first coupling part and the second coupling part guide rotation of the cover about a horizontal rotational axis. A wire connected to the printed circuit board may pass through a groove disposed in at least one of the first coupling part and the second coupling part.

The control box may have a hexahedral box shape with at least one side which is not perpendicular to an adjacent side.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
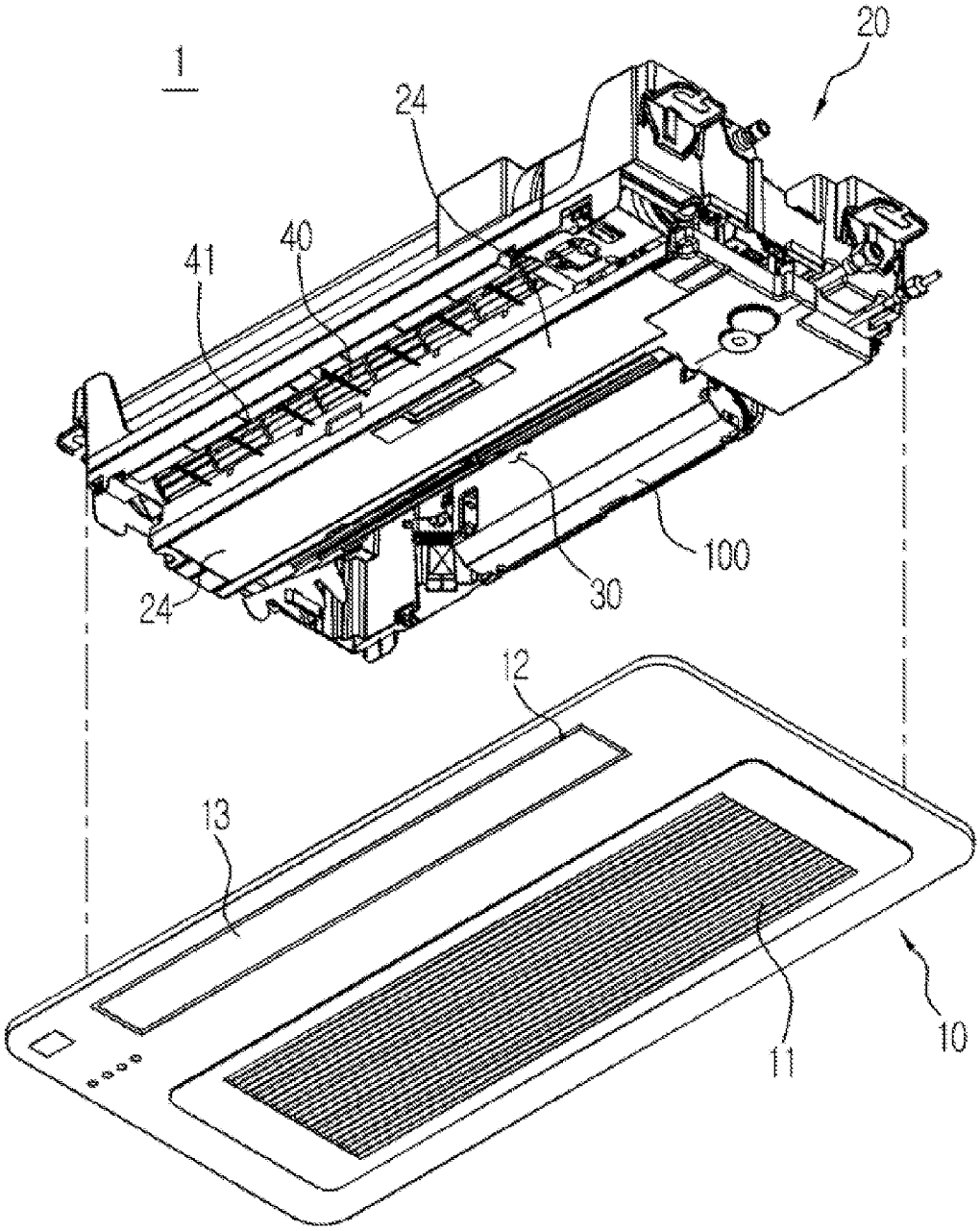
FIG. 1 is a view illustrating a main body and a bottom panel of an indoor unit of a ceiling type air-conditioner in accordance with an embodiment of the disclosure.

Reference will now be made in detail to embodiments of the disclosure, examples of which are illustrated in the accompanying drawings, wherein like reference numerals refer to like elements throughout. The embodiments are described below to explain the disclosure by referring to the figures.

Figure 2:
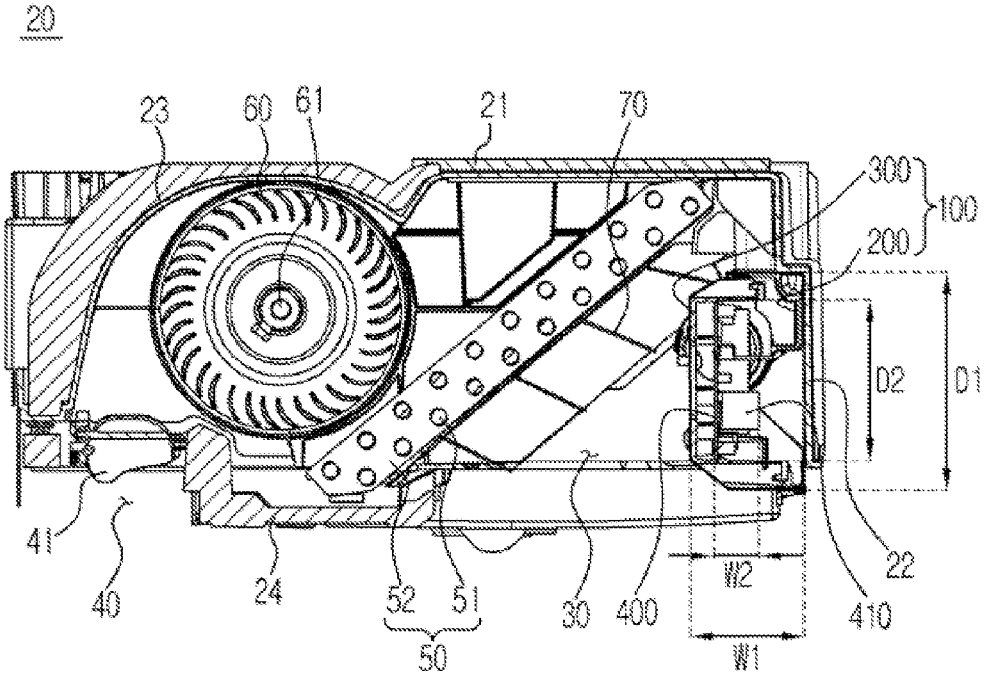
FIG. 2 is a side cross-sectional view illustrating a state in which a control box of the indoor unit of the ceiling type air-conditioner of FIG. 1 is closed.
Figure 3:
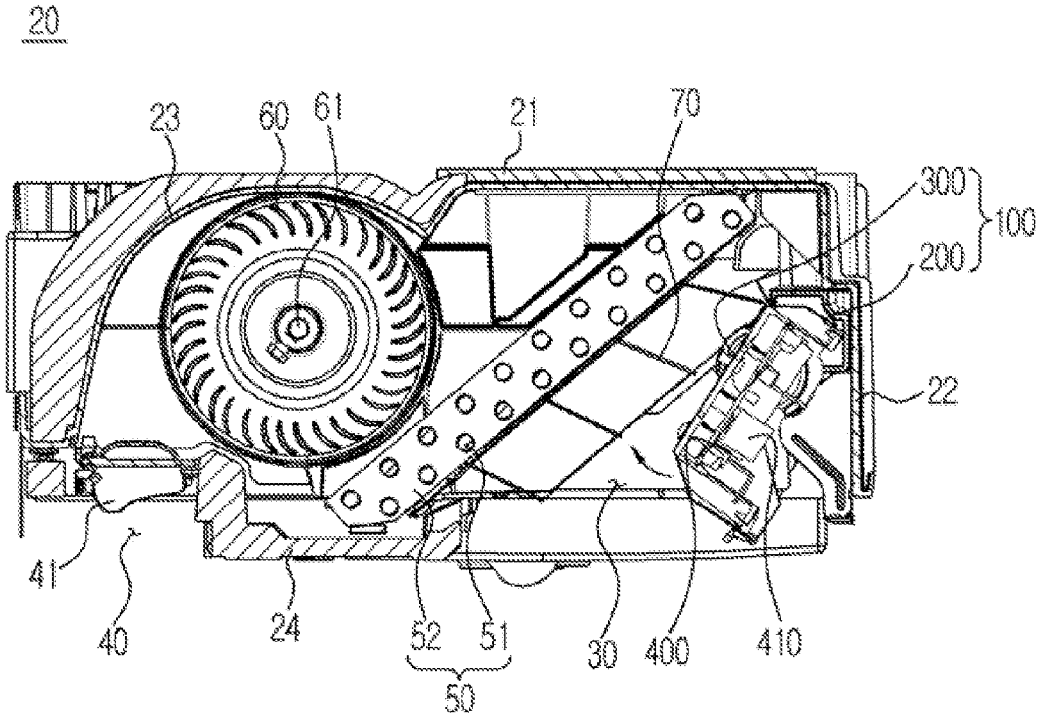
FIG. 3 is a side cross-sectional view illustrating a state in which the control box of the indoor unit of the ceiling type air-conditioner of FIG. 1 is opened.

FIG. 1 is a view illustrating a main body and a bottom panel of an indoor unit of a ceiling type air-conditioner in accordance with an embodiment of the disclosure, FIG. 2 is a side cross-sectional view illustrating a state in which a control box of the indoor unit of the ceiling type air-conditioner of FIG. 1 is closed, and FIG. 3 is a side cross-sectional view illustrating a state in which the control box of the indoor unit of the ceiling type air-conditioner of FIG. 1 is opened. The bottom panel is omitted in FIGS. 2 and 3.

Referring to FIGS. 1 to 3, an indoor unit 1 of a ceiling type air-conditioner in accordance with an embodiment of the disclosure may include a main body 20 which is disposed to be suspended from a ceiling or buried in the ceiling, and a bottom panel 10 which is coupled to a lower portion of the main body 20.

The main body 20 may have approximately a box shape. A heat exchanger 50 in which heat exchange occurs between a refrigerant and sucked indoor air, a blowing fan 60 which forcibly causes air to flow, and a control box 100 which controls an operation of the indoor unit 1 of the ceiling type air-conditioner may be received in (provided in, disposed in, etc.) the main body 20.

The main body 20 may have an upper wall 21, and left, right, front and rear side walls 22. The main body 20 may have a scroll portion 23 which guides the air heat-exchanged through the heat exchanger 50 to an outlet port 40.

An inlet port 30 through which the indoor air is sucked into the main body 20, and the outlet port 40 through which the heat-exchanged air is discharged to a room again may be provided at the lower portion of the main body 20. The outlet port 40 may include a direction control wing 41 which controls a left-to-right (horizontal) direction of the discharged air.

The heat exchanger 50 may include a tube 51 through which the refrigerant flows, and a heat exchange fin 52 which is in contact with the tube 51 in order to increase a heat transfer surface area. The heat exchanger 50 may be inclinedly arranged to be approximately perpendicular to a flow direction of the air. For example, as shown in FIG. 2, the heat exchanger 50 may be inclined at an angle such that an upper portion of the heat exchanger 50 is closer to the upper wall 21 than a lower portion of the heat exchanger 50.

A guide rib 70 which guides the indoor air sucked in through the inlet port 30 into the main body 20 toward the heat exchanger 50 may be provided between the heat exchanger 50 and the inlet port 30. The guide rib 70 may be inclinedly arranged to be approximately perpendicular to a direction in which the heat exchanger 50 is arranged.

A drain cover 24 which collects condensed water generated from the heat exchanger 50 may be provided under (below) the heat exchanger 50. The condensed water collected through the drain cover 24 may be discharged to an outside through a discharge hose (not shown).

The blowing fan 60 may be rotated by a driving force of a driving motor (not shown) and may forcibly cause the air to flow. A rotational shaft 61 of the blowing fan 60 may be provided approximately horizontally (parallel) with the ground (i.e., with a horizontal ground plane). The blowing fan 60 may be a tangential fan, for example.

The bottom panel 10 may include a grill 11 which is provided at a position corresponding to the inlet port 30 so as to prevent foreign substances from being introduced into the main body 20, and a panel outlet port 12 which is provided at a position corresponding to the outlet port 40. A louver 13 which opens and closes the panel outlet port 12 or controls a vertical direction of the discharged air may be rotatably provided at the panel outlet port 12.

The control box 100 may control the operation of the indoor unit 1 of the ceiling type air-conditioner, and a printed circuit board 400 on which various electronic components 410 are mounted may be received in (provided in, disposed in, etc.) the control box 100. The control box 100 may be installed at an inner side of the side wall 22 of the main body 20 adjacent to the inlet port 30.

The control box 100 in accordance with an embodiment of the disclosure may have approximately a hexahedral box shape, and may include a case 200 which is fixed to the main body 20, and a cover 300 which is rotatably coupled to the case 200 so as to open and close the case 200. The case 200 may be fixed to the side wall 22 of the main body 20 adjacent to the inlet port 30. For example, as shown in FIG. 2, the case 200 may be fixed to a side wall 22 such that the case 200 is disposed closer to the heat exchanger 50 than to the blowing fan 60. Further, as shown in FIG. 2, the guide rib 70 may be provided between the heat exchanger 50 and the case 200.

As described above, the control box 100 may be integrally formed so that the case 200 and the cover 300 are mutually coupled. Therefore, upon maintenance of the control box 100 or initial work such as wire connecting, the cover 300 need not be separated from the case 200, and it is sufficient to rotate the cover 300, for example, to access the printed circuit board and/or electronic components disposed inside the control box 100.

Figure 8:
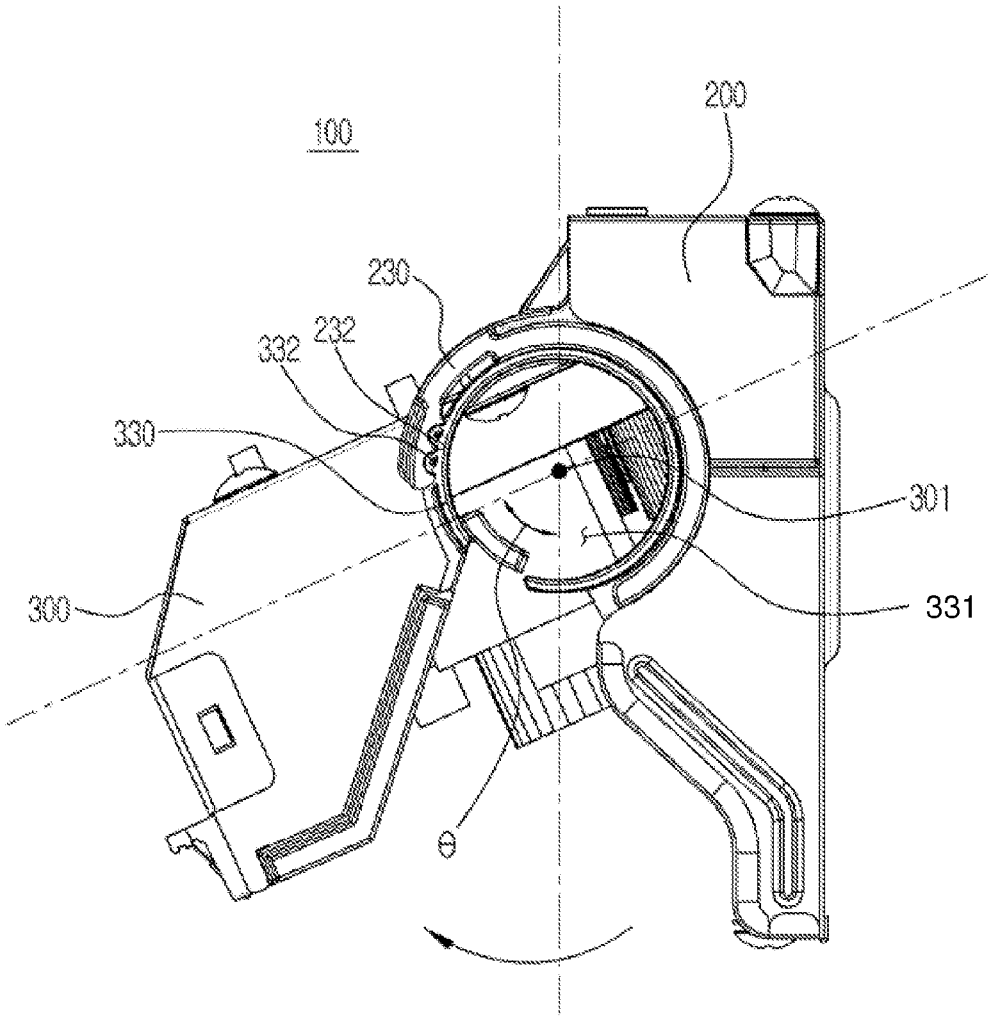
FIG. 8 is a side view illustrating a state in which the control box of the indoor unit of the ceiling type air-conditioner of FIG. 1 is opened.

A rotational shaft 301 (FIG. 8) of the cover 300 may be provided approximately horizontally (parallel) with the ground so as to be approximately in parallel with the rotational shaft 61 of the blowing fan 60, such that the cover 300 is rotated up and down. The rotational shaft 301 of the cover 300 may be provided at approximately an upper portion of the control box 100. Here, the upper portion of the control box 100 may refer to a portion of the control box 100 which is at or above a center of the longitudinal width D1 of the control box 100, when seen in an axial direction of the horizontal rotational shaft 301 (FIG. 8). Therefore, the cover 300 may be opened while being rotated upward and closed while being rotated downward. For example, as shown in FIG. 2 and in FIG. 3, the cover 300 may be opened by rotating the cover 300 in a clockwise direction.

The printed circuit board 400 may be fixed to the cover 300. Therefore, the printed circuit board 400 may be rotated up and down together with the cover 300. The printed circuit board 400 may be disposed to be vertical to the ground when the cover 300 is closed. Further, the printed circuit board 400 may be located so that a surface thereof on which the electronic components 410 are mounted is directed toward the case 200 when the cover 300 is closed. The surface of the printed circuit board 400 on which the electronic components 410 are mounted may be disposed to be vertical to the ground when the cover 300 is closed, and parallel to side wall 22 to which the control box 100 is installed, when the cover 300 is closed.

When the cover 300 is rotated upward (e.g., in the clockwise direction), the printed circuit board 400 may also be rotated upward. If the cover 300 is rotated maximally, the printed circuit board 400 may be located so that the surface thereof on which the electronic components 410 are mounted is directed toward the ground.

Therefore, when it is necessary to maintain or otherwise access the printed circuit board 400 received in the control box 100, the cover 300 of the control box 100 may be rotated upward, and the printed circuit board 400 may be rotated together with the cover 300, and thus a surface of the printed circuit board 400, on which the electronic components 410 are mounted, is directed downward. Therefore, an operator may easily access the printed circuit board 400 from a lower side of the indoor unit 1 of the ceiling type air-conditioner and perform maintenance or the like.

Figure 4:
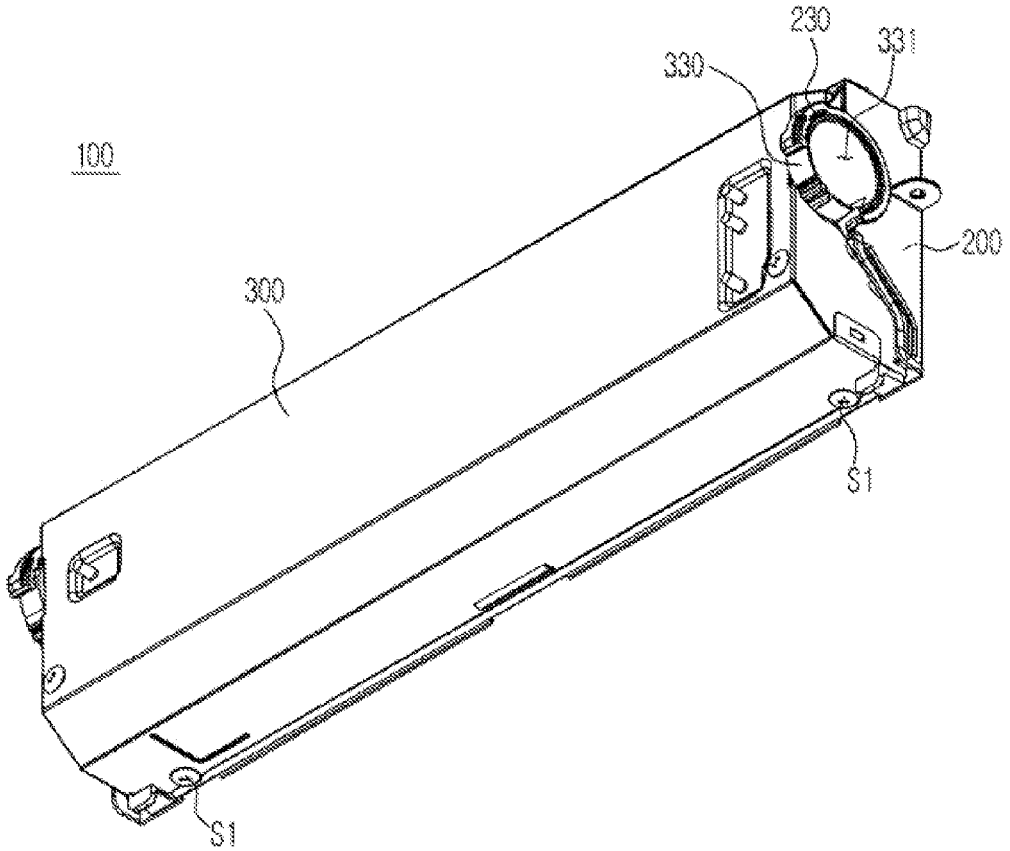
FIG. 4 is a perspective view illustrating the control box of the indoor unit of the ceiling type air-conditioner of FIG. 1.

As illustrated in FIG. 4, the cover 300 may be coupled to the case 200 by a fastening member (e.g., screw S1) so as to be fixed to the case 200 in a state of being closed. The screw S1 may be provided to progress from a lower side to an upper side and thus to be easily tightened or released. As shown in FIG. 4 and in FIG. 6, a screw S1 may be provided at one end of the case 200, and at the other, opposite end of the case 200, and may be used to couple the case 200 together with the cover 300.

As illustrated in FIG. 2, the control box 100 may be disposed so that a transversal width W1 thereof is smaller than a longitudinal width D1 thereof when seen in an axial direction of the horizontal rotational shaft 301 (FIG. 8).

This is because the printed circuit board 400 is vertically disposed in the control box 100 in accordance with an embodiment of the disclosure, and the transversal width W2 of the printed circuit board 400 is generally smaller than the longitudinal width D2 thereof. The transversal width W2 of the printed circuit board 400 may refer to a distance corresponding to the thickness of the printed circuit board 400 plus a height of the tallest electronic component mounted on the printed circuit board 400. The longitudinal width D2 of the printed circuit board 400 may refer to a distance from one end of the printed circuit board 400 to the other end of the printed circuit board 400 in a widthwise direction, which in FIG. 2, is perpendicular to a horizontal ground plane.

In the case of a conventional control box, since the printed circuit board 400 is horizontally disposed, the control box receiving the printed circuit board 400 also has a structure in which the transversal width thereof is greater than the longitudinal width thereof. Therefore, the control box may block the inlet port 30 of the main body 20 and cause problems with air flow.

However, in the control box 100 in accordance with an embodiment of the disclosure, the transversal width W1 may be smaller than the longitudinal width D2 and/or longitudinal width D1. Therefore, encroachment of an area of the inlet port 30 of the main body 20 may be minimized and problems with the air flow of the inlet port 30 may also be minimized.

A maximum rotational range θ (FIG. 8) of the cover 300 of the control box 100 may be variously determined according to a design specification. However, the maximum rotational range θ may be determined within a proper range so as to minimize the encroachment of the inlet port 30 and also to easily access the printed circuit board 400 when the cover 300 is opened.

As an example, the maximum rotational range θ of the cover 300 may be determined to be a range of about 70° to about 90°, and preferably about 73° to about 75°. For example, the guide rib 70 may interfere with the cover 300, and thus a maximum rotational angle thereof may be limited. That is, when the cover 300 is maximally opened, the cover 300 may be in contact with the guide rib 70.

A detailed configuration or arrangement of the control box 100 will be described below.

Figure 5:
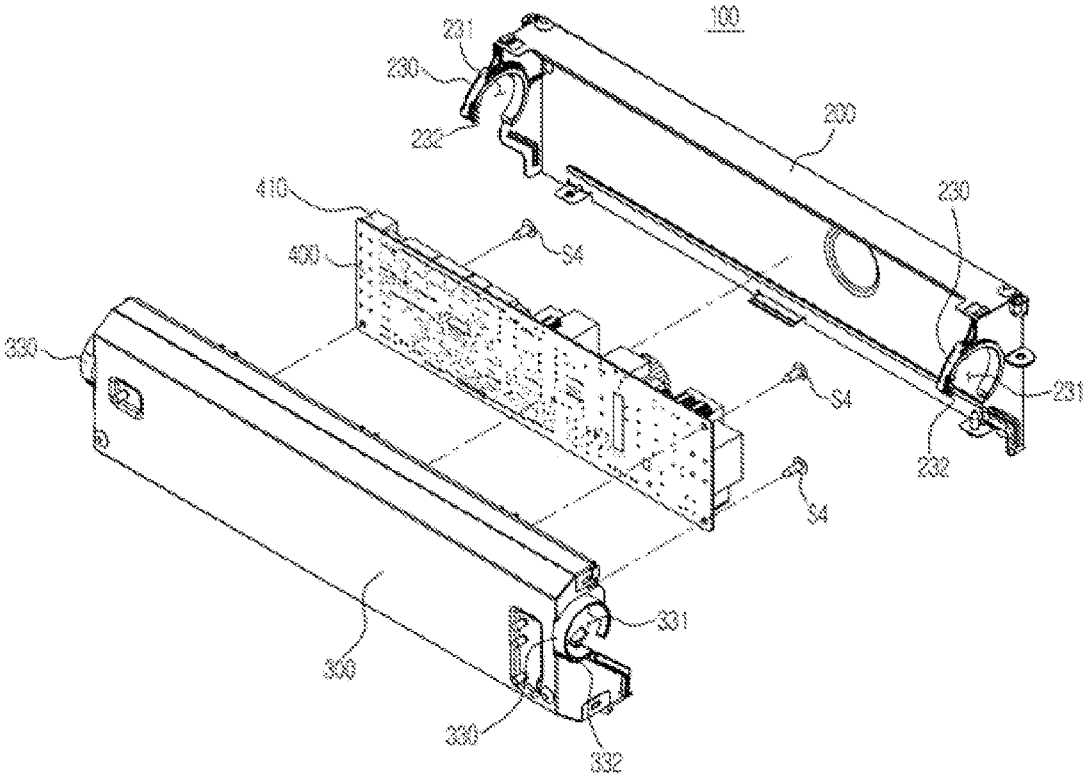
FIG. 5 is an exploded perspective view illustrating the control box of the indoor unit of the ceiling type air-conditioner of FIG. 1.
Figure 6:
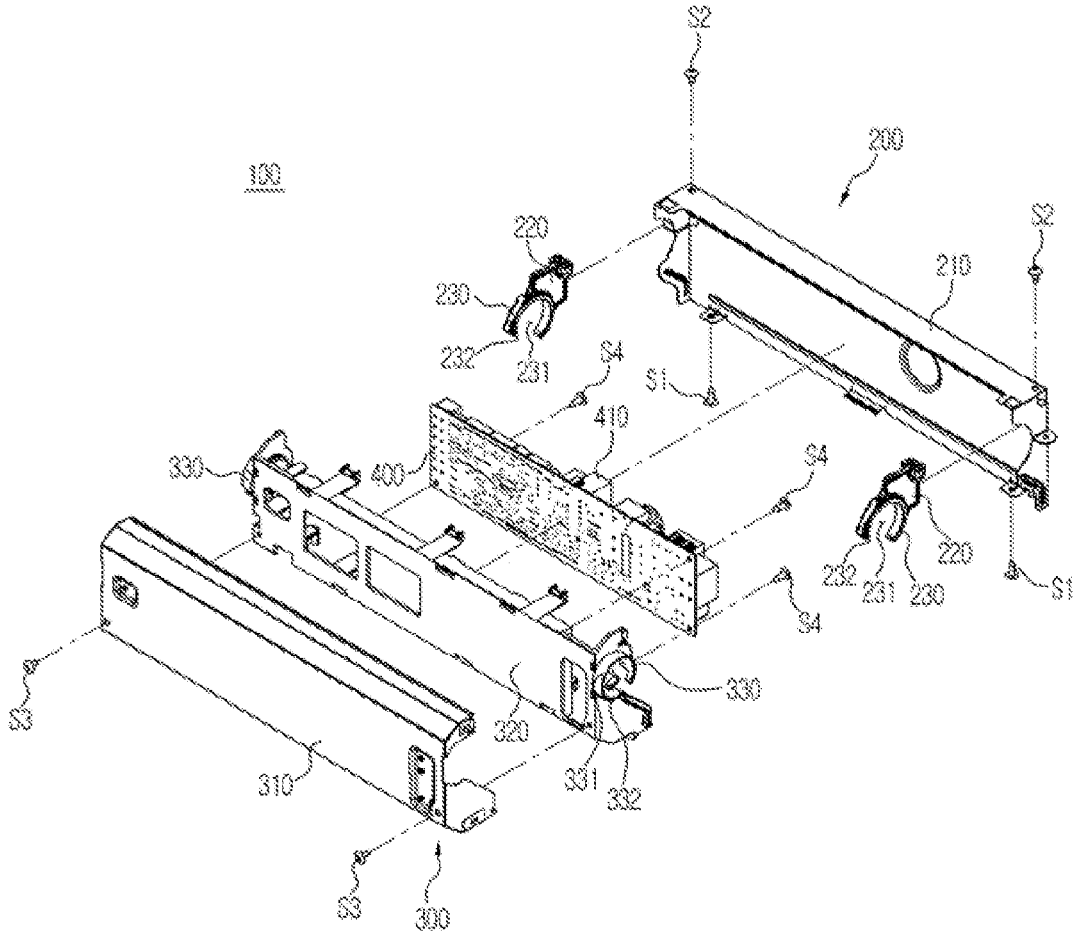
FIG. 6 is another exploded perspective view illustrating the control box of the indoor unit of the ceiling type air-conditioner of FIG. 1.
Figure 7:
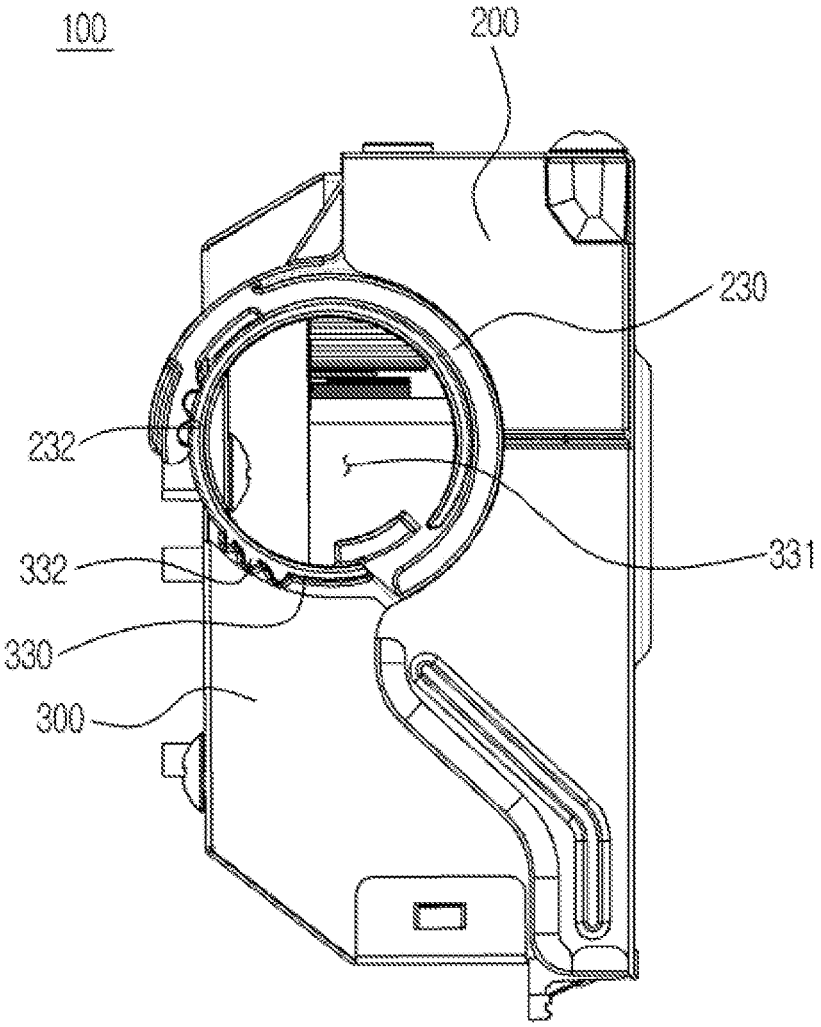
FIG. 7 is a side view illustrating a state in which the control box of the indoor unit of the ceiling type air-conditioner of FIG. 1 is closed.

FIG. 4 is a perspective view illustrating the control box of the indoor unit of the ceiling type air-conditioner of FIG. 1, FIG. 5 is an exploded perspective view illustrating the control box of the indoor unit of the ceiling type air-conditioner of FIG. 1, FIG. 6 is another exploded perspective view illustrating the control box of the indoor unit of the ceiling type air-conditioner of FIG. 1, FIG. 7 is a side view illustrating a state in which the control box of the indoor unit of the ceiling type air-conditioner of FIG. 1 is closed, and FIG. 8 is a side view illustrating a state in which the control box of the indoor unit of the ceiling type air-conditioner of FIG. 1 is opened.

Referring to FIGS. 4 to 8, the case 200 of the control box 100 may be configured or arranged by coupling a case body 210 and one pair of guide members 220 which may be provided at both sides of the case body 210. The one pair of guide members 220 may be firmly coupled to both of the sides of the case body 210 by one or more fastening members (e.g., screw S2). As shown in FIG. 6 for example, a screw S2 may be provided at one end of the case body 210, and at the other, opposite end of the case body 210, and may be used to couple the case body 210 together with the guide members 220. As shown in FIG. 6 for example, the screws S2 may be provided to progress from an upper side to a lower side of the case body 210.

The case body 210 may be formed of a metallic material so as to provide a predetermined strength. As an example, the case body 210 may be formed of a galvanized steel plate. The pair of guide members 220 serves to couple the case 200 and the cover 300, and may be formed by injection-molding a resin material.

Each of the guide members 220 may include a fixed coupling part 230 for coupling with the cover 300. The fixed coupling part 230 may have a ring shape or a partly cut-away ring shape, (e.g., an approximately horse-shoe shape, or U-shape, etc.).

The fixed coupling part 230 serves to rotatably support a rotational coupling part 330 to be described later. Therefore, the fixed coupling part 230 and the rotational coupling part 330 substantially serve as a rotational shaft portion of the cover 300. The fixed coupling part 230 may be formed of an elastic material so as to be in close contact with the rotational coupling part 330 and thus to reinforce a coupling force with the rotational coupling part 330.

The cover 300 may be formed by coupling an external cover 310 and an internal cover 320. The printed circuit board 400 may be coupled to the internal cover 320. The printed circuit board 400 may be coupled to the internal cover 320 by one or more fastening members (e.g., screw S4). As shown in FIG. 5 and FIG. 6 for example, a plurality of screws S4 may be provided to progress from an outer side of the printed circuit board 400 (i.e., the side of the printed circuit board 400 on which the electronic components are mounted) to an inner side of the printed circuit board 400 and further to the internal cover 320. As shown in FIG. 5 and FIG. 6, three screws S4 may be used to couple the printed circuit board 400 to the internal cover 320 (e.g., two screws S4 provided at one end of the printed circuit board 400, and one screw S4 provided at the other, opposite end of the printed circuit board 400). However, the disclosure is not so limited, and less than three screws or more than three screws may be to couple the printed circuit board 400 to the internal cover 320.

The external cover 310 and the internal cover 320 may be coupled by one or more fastening members (e.g., screw S3). As shown in FIG. 6 for example, a screw S3 may be provided at one end of the external cover 310, and at the other, opposite end of the external cover 310, and may be used to couple the external cover 310 together with the internal cover 320. As shown in FIG. 6 for example, the screws S3 may be provided to progress from the outer external side of the external cover 310 to the inner internal side of the external cover 310 and further to the internal cover 320.

The external cover 310 may be formed of a metallic material so as to provide a predetermined strength. As an example, the external cover 310 may be formed of a galvanized steel plate. The internal cover 320 may be formed by injection-molding a resin material.

The internal cover 320 may include the rotational coupling part 330 which is rotatably coupled to the fixed coupling part 230. The rotational coupling part 330 may have the ring shape or the partly cut-away ring shape. As shown in FIG. 7 and FIG. 8 for example, the rotational coupling part 330 may have a diameter which is smaller than a diameter of the fixed coupling part 230, such that the rotational coupling part 330 is accommodated inside the fixed coupling part 230 in a concentric manner.

In an embodiment, the rotational coupling part 330 may be coupled to an inner side of the fixed coupling part 230. However, the disclosure is not limited thereto, and the rotational coupling part 330 may also be coupled to an outer side of the fixed coupling part 230. That is, for example, in an alternative embodiment the rotational coupling part 330 may have a diameter which is larger than a diameter of the fixed coupling part 230, such that the fixed coupling part 230 is accommodated inside the rotational coupling part 330 in a concentric manner.

The fixed coupling part 230 and the rotational coupling part 330 may form a concentric circle. The fixed coupling part 230 and the rotational coupling part 330 may have wiring grooves 231 and 331, respectively, through which a wire (not shown) connected to the printed circuit board 400 passes.

The wiring grooves 231 and 331 may be formed in both sides of the control box 100, for example. A wire connecting the printed circuit board 400 and an external power source located at an outside of the indoor unit 1 may pass through the wiring grooves 231 and 331 formed in one of the sides, and a wire connecting the printed circuit board 400 and a component located at an inside of the indoor unit 1 may pass through the wiring grooves 231 and 331 formed in the other side.

As described above, since the wiring grooves 231 and 331 may be formed in the fixed coupling part 230 and the rotational coupling part 330 which form the rotational shaft portion of the cover 300, positions of the wiring grooves 231 and 331 are not changed even when the cover 300 is rotated. Therefore, the wires passing through the wiring grooves 231 and 331 and connected to the printed circuit board 400 may not be moved or affected by the cover 300 even when the cover 300 is rotated.

The fixed coupling part 230 and the rotational coupling part 330 may have stopper protrusions 232 and 332, respectively, which are mated with each other so as to fix the cover 300 in a state in which the cover 300 is opened.

In an embodiment, since the rotational coupling part 330 may be coupled to the inner side of the fixed coupling part 230, the stopper protrusion 232 of the fixed coupling part 230 may be formed to protrude inward, and the stopper protrusion 332 of the rotational coupling part 330 may be formed to protrude outward. However, if the rotational coupling part 330 is coupled to the outer side of the fixed coupling part 230, the stopper protrusion 232 of the fixed coupling part 230 may be formed to protrude outward, and the stopper protrusion 332 of the rotational coupling part 330 may be formed to protrude inward.

An operation of the control box 100 of the indoor unit 1 of the ceiling type air-conditioner in accordance with an embodiment of the disclosure will be described.

Referring to FIG. 2, the control box 100 may be installed at the main body 20 so that the printed circuit board 400 is disposed to be vertical to the ground, and electronic components 410 protruding from a surface of the printed circuit board 400 are disposed to be parallel to the ground. Therefore, the transversal width W1 of the control box 100 is smaller than the longitudinal width D1 thereof and/or of the longitudinal width D1 of the printed circuit board 400, when seen in the axial direction of the rotational axis of the cover 300, and thus the encroachment of the area of the inlet port 30 of the main body 20 may be minimized and problems with the air flow of the inlet port 30 may also be minimized.

When it is necessary for an operator to access an inner side of the control box 100, the fastening member (e.g., screw S1) (FIG. 4) coupling the case 200 and the cover 300 may be first released, and then the cover 300 may be rotated upward (e.g., in a clockwise direction) so as to open the control box 100. If the cover 300 is maximally rotated, the stopper protrusion 232 of the fixed coupling part 230 may be mated with the stopper protrusion 332 of the rotational coupling part 330, and thus the cover 300 may be fixed in the state of being opened. As disclosed herein, various fastening members may be used to secure or couple various components together. As noted above, an example fastening member may include a screw. However, the disclosure is not so limited. For example, a fastening member may include bolts, pins, rivets, anchors, adhesives, etc., so long as the desired performance (e.g. the secure coupling of components) may be achieved.

As described above, since the case 200 and the cover 300 may be formed integrally, it is not necessary to separate and remove the cover 300 from the case 200 in order to open the control box 100, and also work convenience is enhanced.

When the cover 300 is rotated, the printed circuit board 400 fixed to the cover 300 is also rotated. While the cover 300 is maximally opened, the printed circuit board 400 is located so that a surface thereof on which the electronic components 410 are mounted is directed downward. The maximum rotational range of the cover 300 may be an angle of about 70° to about 90°. Therefore, the operator is able to easily access the printed circuit board 400 including the electronic components 410 mounted thereon, and the operator may more easily perform maintenance or the like.

Since the wiring grooves 231 and 331 of the control box 100 may be formed in the fixed coupling part 230 and the rotational coupling part 330, respectively, which form the rotational shaft portion of the cover 300, the positions of the wiring grooves 231 and 331 may not be changed, and also the wires passing through the wiring grooves 231 and 331 may not be moved or affected by the cover 300 even when the cover 300 is rotated.

After the maintenance is completed, the cover 300 may be rotated reversely (e.g., in a counterclockwise direction), and the cover 300 and the case 200 may be fastened again by using the screw 51, and thus the cover 300 may be fixed.

In the indoor unit of the ceiling type air-conditioner in accordance with the various aspects of the disclosure, since the control box is configured or arranged with the fixed case and the rotatable cover which is hinged to the case, and opened and closed by rotation of the cover, it is easy to perform the connection and maintenance on the electronic components in the control box.

Also, since the control box is installed at the side wall of the main body adjacent to the inlet port so that the transversal width thereof is smaller than the longitudinal width thereof, problems with the air flow of the inlet port are minimized and the reliability of the ceiling type air-conditioner is improved.

Although embodiments of the disclosure have been shown and described, it would be appreciated by those skilled in the art that changes may be made to these embodiments without departing from the principles and spirit of the disclosure, the scope of which is defined in the claims and their equivalents.

What is claimed is:

1. An indoor unit of a ceiling type air-conditioner, comprising:

a main body having an inlet port and an outlet port provided at a lower portion thereof;

a heat exchanger;

a blowing fan; and a control box comprising a case fixed to an inner side of a side wall of the main body at a location adjacent to the inlet port, and a cover rotatably coupled to the case so as to open and close the case and to which a printed circuit board is fixed.

2. The indoor unit according to claim 1, wherein a rotational shaft of the cover is in parallel with a rotational shaft of the blowing fan and located at an upper portion of the control box.

3. The indoor unit according to claim 1, wherein the cover is opened while being rotated upward, and closed while being rotated downward.

4. The indoor unit according to claim 1, wherein the printed circuit board is disposed to be vertical when the cover is closed.

5. The indoor unit according to claim 1, wherein the printed circuit board is disposed so that a surface thereof on which electronic components are mounted is directed downward when the cover is opened.

6. The indoor unit according to claim 1, wherein a maximum rotational angle of the cover is in a range of about 70° to about 90°.

7. The indoor unit according to claim 1, wherein a transversal width of the control box is smaller than a longitudinal width thereof when seen in an axial direction of a rotational shaft of the cover.

8. The indoor unit according to claim 1, wherein the cover is configured to rotate toward a rotational axis of the blowing fan to open the case and to rotate away from the rotational axis of the blowing fan to close the case.

9. The indoor unit according to claim 1, further comprising a guide rib which is provided adjacent to the heat exchanger and guides indoor air sucked through the inlet port to the heat exchanger.

10. The indoor unit according to claim 9, wherein the control box is installed between the guide rib and the side wall of the main body.

11. The indoor unit according to claim 10, wherein the guide rib interferes with the cover, and limits a maximum rotational angle of the cover.

12. The indoor unit according to claim 1, wherein the case comprises a fixed coupling part which guides rotation of the cover.

13. The indoor unit according to claim 12, wherein the fixed coupling part has a ring shape or a partly cut-away ring shape.

14. The indoor unit according to claim 12, wherein the cover comprises a rotational coupling part which is rotatably coupled to the fixed coupling part.

15. The indoor unit according to claim 14, wherein the rotational coupling part has a ring shape or a partly cut-away ring shape.

16. The indoor unit according to claim 14, wherein at least one of the fixed coupling part and the rotational coupling part has a wiring groove through which a wire connected to the printed circuit board passes.

17. The indoor unit according to claim 16, wherein a position of the wiring groove is not changed when the cover is rotated.

18. The indoor unit according to claim 14, wherein the fixed coupling part and the rotational coupling part include stopper protrusions which are mated with each other to fix the cover when the cover is opened.

19. The indoor unit according to claim 1, wherein the cover and the case are coupled with each other by at least one fastening member so that the cover is fixed when the cover is closed.

20. The indoor unit according to claim 12, wherein the case is formed by coupling a case body formed of a metallic material and a guide member which includes the fixed coupling part, and the guide member is formed with an injection-molded resin material.

21. The indoor unit according to claim 14, wherein the cover is formed by coupling an external cover formed of a metallic material and an internal cover, the internal cover includes the rotational coupling part, and has the printed circuit board fixed thereto, and the internal cover is formed with an injection-molded resin material.

22. An indoor unit of a ceiling type air-conditioner, comprising:

a main body having an inlet port and an outlet port provided at a lower portion thereof;

a heat exchanger;

a blowing fan;

a guide rib which is provided adjacent to the heat exchanger and guides indoor air sucked in through the inlet port toward the heat exchanger; and a control box comprising a case which is fixed to a side wall of the main body and a cover which is coupled to the case so as to be rotatable around a horizontal rotational axis to open and close the case, wherein the control box is installed between the side wall of the main body and the guide rib, such that a transversal width of the control box is smaller than a longitudinal width of the control box when seen in an axial direction of the horizontal rotational axis.

23. An indoor unit of a ceiling type air-conditioner, comprising:

a main body having an inlet port and an outlet port provided at a lower portion thereof;

a heat exchanger;

a blowing fan; and a control box comprising:

a case fixed to the main body and has a fixed coupling part, and a cover which has a rotational coupling part rotatably coupled to the fixed coupling part and is rotatable around a horizontal rotational axis, wherein at least one of the fixed coupling part and the rotational coupling part has a wiring groove through which a wire passes.

24. A ceiling type air-conditioner, comprising:

an indoor unit, comprising:

a main body having an inlet port and an outlet port provided at a lower portion thereof, and a control box including a case fixed to an inner side of a side wall of the main body at a location adjacent to the inlet port, and a cover which is rotatable to access a printed circuit board disposed inside the control box, wherein, when the cover is in a closed position, the printed circuit board is arranged vertically to be parallel to the side wall of the main body such that electronic components mounted on the printed circuit board are directed in a substantially perpendicular direction to the side wall.

25. The ceiling type air-conditioner according to claim 24, wherein when the cover is rotated to an open position, the printed circuit board moves together with a rotation of the cover, such that the electronic components mounted on the printed circuit board are directed to face toward the lower portion of the main body.

26. The ceiling type air-conditioner according to claim 24, wherein a width of the control box corresponding to a first direction which is parallel to a horizontal ground plane is less than a length of the control box in a second direction which is perpendicular to the horizontal ground plane and parallel to the side wall.

27. The ceiling type air-conditioner according to claim 24, wherein the control box includes an internal member which is coupled to the cover on one side, and is coupled to the printed circuit board and the case on the other side, and the internal member includes a first coupling part which is coupled together with a second coupling part disposed at the case such that the first coupling part and the second coupling part guide rotation of the cover about a horizontal rotational axis.

28. The ceiling type air-conditioner according to claim 27, wherein a wire connected to the printed circuit board passes through a groove disposed in at least one of the first coupling part and the second coupling part.

29. The ceiling type air-conditioner according to claim 24, wherein the control box has a hexahedral box shape with at least one side which is not perpendicular to an adjacent side.

* * * * *